US006230371B1

(12) United States Patent
Chu

(10) Patent No.: US 6,230,371 B1
(45) Date of Patent: May 15, 2001

(54) PAINTBALL PISTOL GRAVITY CENTER COMPENSATION DEVICE

(76) Inventor: Stephen Chu, 805 Anderson Way, San Gabriel, CA (US) 91776

( * ) Notice: Subject to any disclaimer, the term of this patent is extended or adjusted under 35 U.S.C. 154(b) by 0 days.

(21) Appl. No.: 09/356,331

(22) Filed: Jul. 19, 1999

(51) Int. Cl.[7] ..... A44B 11/00; F41C 33/00

(52) U.S. Cl. ..... 24/197; 24/2.5; 24/17 B; 24/196; 24/3.13; 24/306

(58) Field of Search ..... 24/197, 196, 17 A, 24/17 B, 17 AP, 3.13, 306, 2.5

(56) References Cited

U.S. PATENT DOCUMENTS

| | | | | |
|---|---|---|---|---|
| 3,640,273 | * | 2/1972 | Ray | 24/306 |
| 4,878,274 | * | 11/1989 | Patricy | 24/306 |
| 5,582,337 | * | 12/1996 | McPherson et al. | 24/306 |
| 5,845,374 | * | 12/1998 | Briggs | 24/306 |
| 5,997,039 | * | 12/1999 | Manninen | 24/196 |
| 6,029,321 | * | 2/2000 | Fisher | 24/17 B |

* cited by examiner

*Primary Examiner*—Victor N. Sakran

(57) ABSTRACT

The present invention relates to a device for adapting a paintball pistol such that effective support via the holders hand to compensate for a forward center of gravity is shifted substantially completely from the holder's trigger finger to the back of the holder's hand.

7 Claims, 5 Drawing Sheets

200
216
206
105
211
201
215
202
201

204
203
206
209
205
211
214

105
301
300

200
201
202
203
206
207
208
204
210
209
212
213
301
205
211

PAINTBALL PISTOL GRAVITY CENTER COMPENSATION DEVICE

BACKGROUND OF THE INVENTION

The present invention relates to a device for adapting a paintball pistol such that a center of gravity compensation for effective support is shifted substantially completely from the holder's trigger finger to the holder's hand.

Paintball pistols are well known in the art to comprise a device with substantial length (about 1.5 to 2 feet) and substantial weight (about 5 to 6 pounds). Typically, means for securely engaging a CO2 cartridge project from about the same line as the axis of the long barrel, albeit in the opposite direction toward the holder. The long barrel is often provided with "pump" means for loading a paintball into the firing chamber within the barrel. These pump means require that a right handed holder of the pistol grip grasp a slider piece with a left hand at the underside of the barrel and move the slider piece forward and backward. In addition, while holding the pistol grip with a right hand, the user often must replace the CO2 cartridge with a left hand by sliding toward themselves or levering to the side some portion of the means for securely engaging the CO2 cartridge. Finally, the user desires to perform the desired activity intended for the paintball pistol, i.e., raising the pistol to eye level preferably with a single arm and firing the pistol.

The present state of the art in paintball pistols is to form a device with a center of gravity somewhat forward of the trigger guard as relating to the length of the pistol. For other firearms and air pistols this is not an especially challenging maneuver. The non-user not familiar with paintball pistols may partially appreciate the problem by holding up 5 to 6 pounds in a hand at the end of an outstretched arm at eye level and then tilting the mass of 5 to 6 pounds in a forward direction away from the engaged hand. This problem is compounded by needing to maintain that position for some period of time while a targeted person comes into view or that the user may be stooping and standing up while walking to avoid other players or running either in pursuit or away from other players. In the case of paintball pistols, the center of gravity becomes critical to the user.

It is known that the long barrel, slider piece and paintball loading chute are essential locate forward of the pistol grip of a paintball pistol. The counterbalance of the CO2 cartridge securing means is inadequate against such mass forward of it. There is a need to provide means such that a paintball pistol user may use the paintball pistol through the several actions of aiming, maintaining a ready position, firing, moving the slider to reload, replacing the CO2 cartridge, and carrying the pistol at the side of the user in a single hand with significantly less effort than previously known.

SUMMARY OF THE INVENTION

The present invention comprises single and doubled strap means secured between a paintball pistol grip piece and the pistol grip frame. The single strap means are especially effective when combined with a glove or partial glove. The doubled strap means are especially effective when a hand covering portion of the strap means is flexible although supportively rigid, having some padding between the rigid section and the back of user's hand.

DETAILED DESCRIPTION OF THE INVENTION

Figure 1:
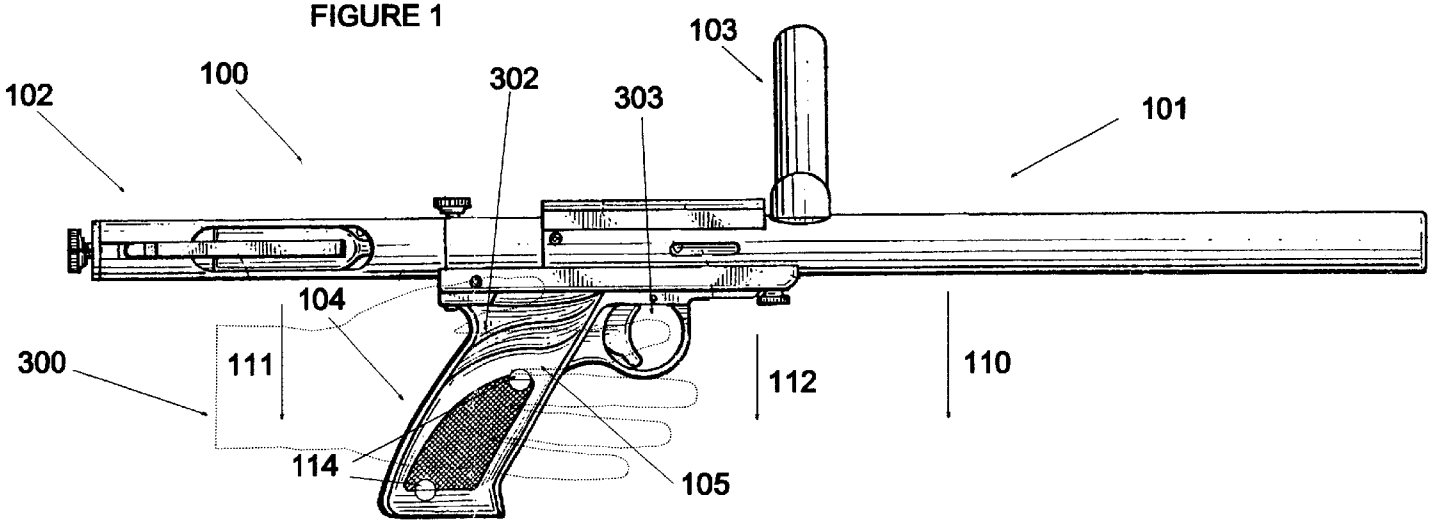
FIG. 1 is a side view of a prior art paintball gun in a horizontal, aiming position showing the separate centers of gravity of forward and rear sections and the overall center of gravity.
Figure 2:
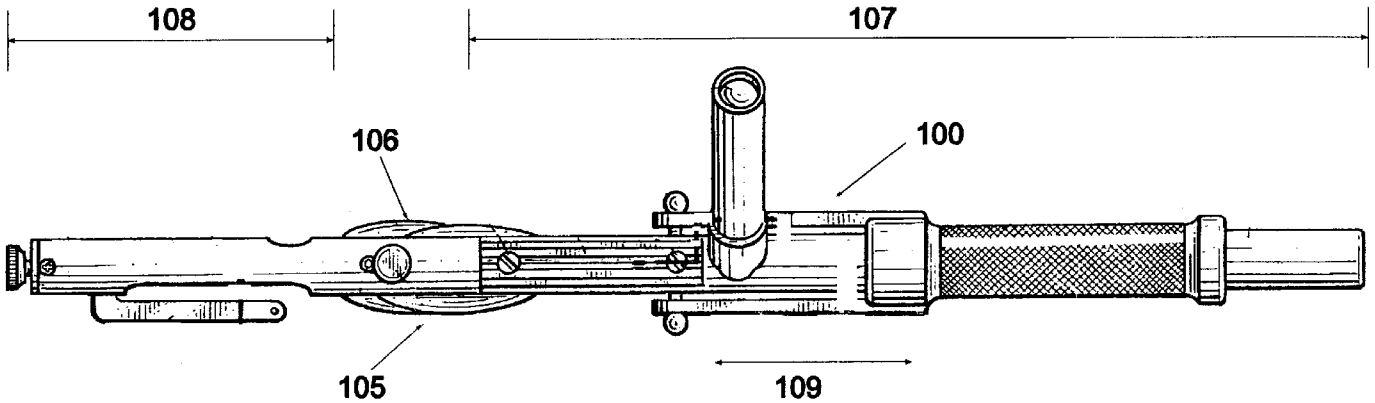
FIG. 2 is a top view of the paintball gun of FIG. 1.

The invention is now discussed with reference to the Figures. FIG. 1 shows a prior art paintball pistol 100 typical of many currently available. Pistol 100 comprises a forward section 107 having a center of gravity at about location 110 and a rear section 108 with a center of gravity at about location 111. The overall center of gravity for pistol 100 is about at location 112, substantially forward of the user's forefinger used for pulling the trigger, i.e., the foremost downward support point 303 of hand outline 300. The user's hand 300 also substantially supports the downward weight of pistol 100 at downward support point 302 with the opposing thumb and three fingertips (pressing against grip piece 106) and a portion of the users fingers and palm (pressing against grip piece 105). The critical effect of pistol having a weight of 5 to 6 pounds is that the forward center of gravity at location 112 necessitates that the forefinger must not only smoothly pull the trigger but must also support the front loaded weight of the pistol 100 at point 303. Section 107 comprises a heavy barrel 101, slider piece that moves in direction 109, as in FIG. 2, paint pellet loader 103 and a substantial portion of the metal frame. Section 102, in counterbalance, comprises only the CO2 cartridge securement means 102, with no portion of the frame effectively extended to draw more proximate the center of gravity of the overall pistol 100.

Pistol grip 104 comprises opposing right grip piece 105 and left grip piece 106 secured to the intervening frame with screws 114. The outline 300 in FIG. 1 shows a typical user hand with extended lower fingers (instead of normally flexed and opposing the palm). Some users in desperation of the heavy weight of the pistol 100 at point 303 extend their middle finger to provide some relief by upwardly supporting the bottom of the trigger guard. This of course seriously impairs aiming skill. Unlike any other pistol, the paintball pistol requires the user to continuously be prepared over the course of a sometimes hours long games to aim and fire the paintball pistol, run, stoop, stand with some degree of such preparedness where the overall weight of the pistol and forward center of gravity erode the ability of the user to accurately aim the pistol. In addition, the users hand must also support the loading activities for the paint pellets and CO2 cartridges, where again because of the unfavorable location of the center of gravity, point 302 receives pressure to maintain pistol 100 in a relatively horizontal position to view the proper loading ports or openings.

The present invention comprises strap means to distribute along the outer surface of the portion of the user's hand effectively lateral to right grip piece 105 a substantial portion of the downward weight of pistol 100 such that the user's wrist instead of the user's strength of their opposing thumb / fingers / palm is used for such support. The opposing thumb 1 fingers / palm strength thereby is more devoted to maintaining pistol 100 in a horizontal position over the forward center of gravity at location 112.

Figures 3, 4, 5, 6:
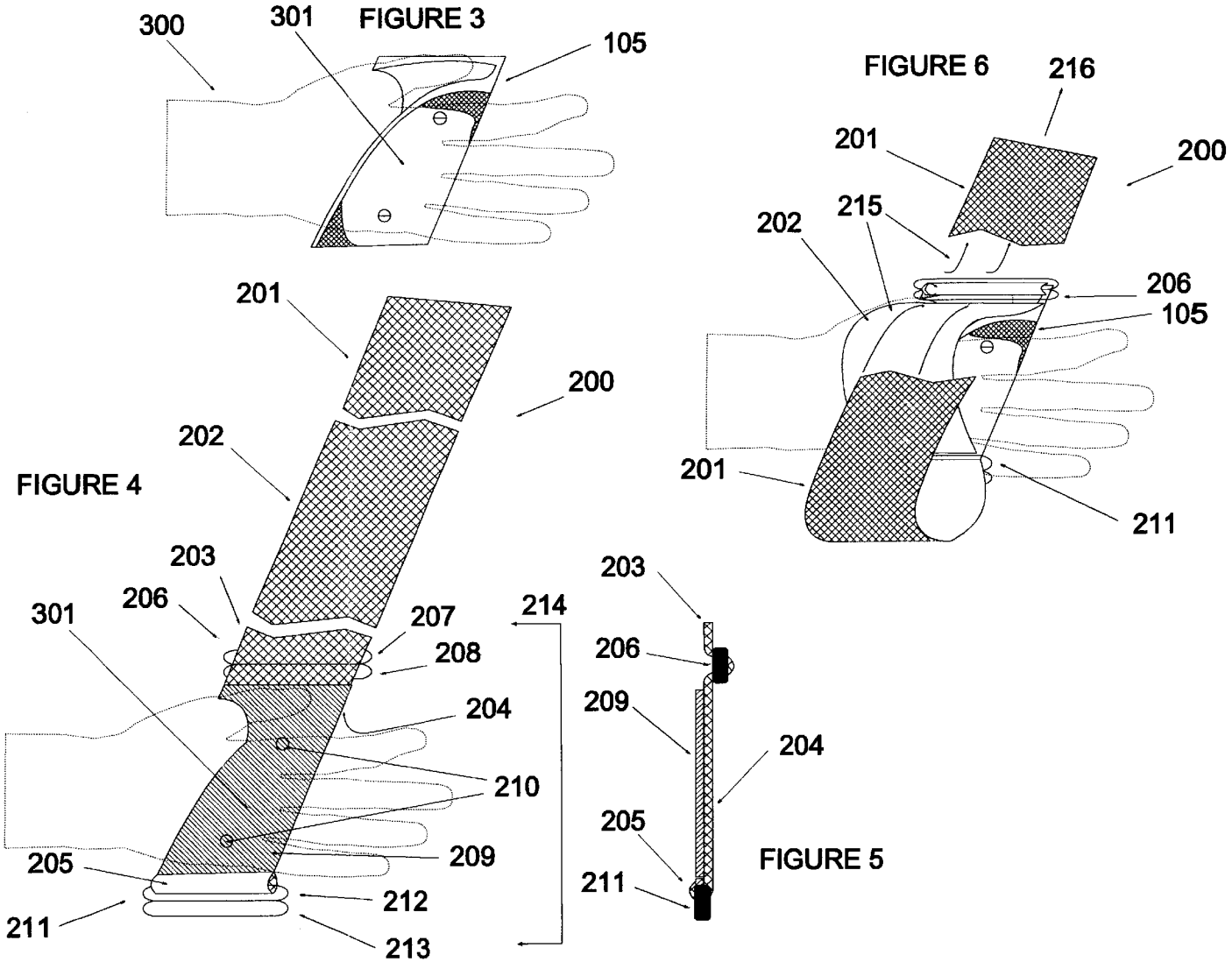
FIG. 3 is a side view of a broken line outline of a users hand in a holding orientation with respect to a pistol grip piece as in the device of FIGS. 1 and 2.
FIG. 4 is a double strap means of the present invention.
FIG. 5 is the double strap means of FIG. 5 in side view 214 of FIG. 5.
FIG. 6 is the double strap means of FIGS. 5 and 6 shown in pistol mounted relation to the pistol grip piece of FIG. 3 and having the strap drawn through two slotted pieces to secure the user's hand to the side of the pistol grip piece.

FIG. 3 shows and exemplary right grip piece 105 with hand outline 300 and the just described portion of the user's hand effectively lateral to right grip piece 105, i.e., hand portion 301. It is intended that the strap means of the invention shall compress portion 301 effectively toward the outer surface of right grip piece 105.

FIG. 5 shows a preferred embodiment of the double strap means 200 of the present invention. A continuous elastic strap with a width of about 1.5 to 3 inches (about the width of piece 105) extends from double back section 201 through a broken away section to hand portion compression section 202 and then through another broken away section to grip top section 203. Section 203 is continuous with a grip portion 204 secured by adhesive, thermal or IR welding bonding to rigid section 209 having a planar structure and an outline substantially the same as grip piece 105. The grip portion 204 is further continuous with grip lower section 205, which forms a secured loop whereby a small portion of the inner faces of section 205 are joined by stitching or other joining means to provide secure attachment of dual slotted piece 211 through its slot 212 leaving open slot 213. A second dual slotted piece 206 is threadedly attached to section 203, piece 206 comprising slots 207 and 208 through which are threaded section 203. Holes 210 are made to adapt to permit screws 114 to pass through them. To install the double strap means 200, screws 114 are removed from pistol 114 to permit removal of piece 105. Sections 209 and 204 are made to align with piece 105 and intervene between it and the pistol grip 104 frame when screws 114 are replaced to fix both piece 105 and the double strap means 200 to pistol 100.

Figure 7:
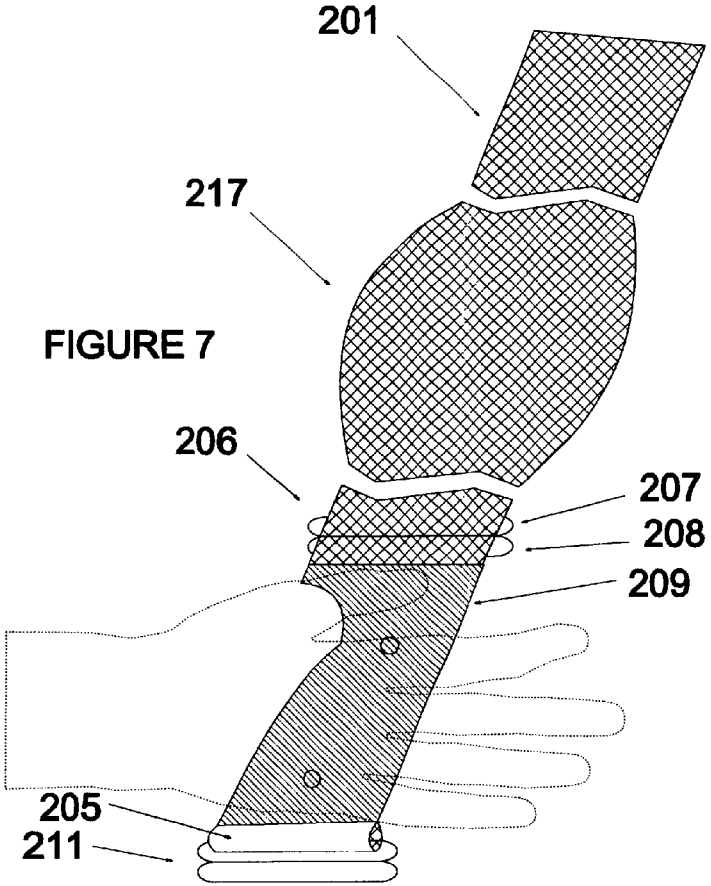

FIG. 7 shows the means 200 as it would appear affixed with piece 105 to a pistol 100, although pistol 100 is not otherwise shown for simplicity. Section 201 is threaded as shown first through slot 213 of dual slotted piece 211, thereby drawing the inside face of section 202 across the back of the user's hand 300 in portion 301. The end of section 201 is then threaded through a outer surface access to slot 208 through immediately to slot 207 through directions 215 and thereafter upward in direction 216 to permit compressive securement of section 202 across portion 301 to the outer face of piece 105. As section 201 is drawn up in direction 216, excess amounts of section 201 are drawn or threaded through, successively, slots 213, 208 and 207, thereby increasing the tension of both section 202 and overlaying it section 201, whereby the outside surfaces of the two sections oppose one another. Thus a double strap secures portion 301 to the outside surface of piece 105.

Figure 8:
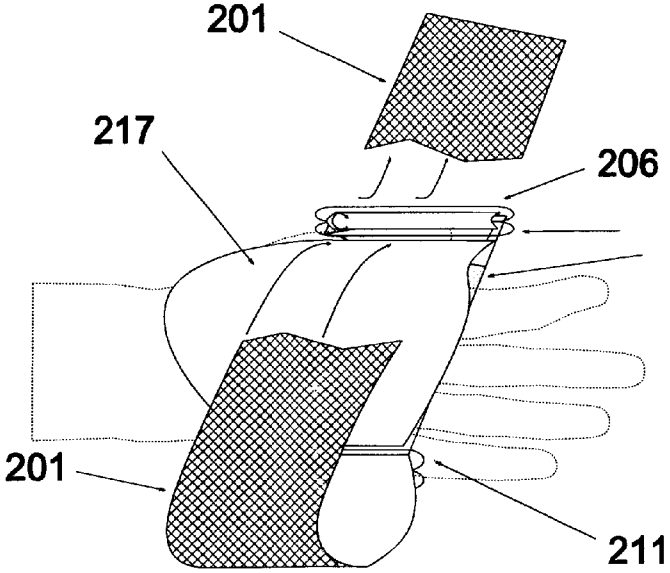
FIGS. 7 and 8 show substantially the device and assembly of FIGS. 5 and 7, except that double strap means comprises a substantially broadened hand covering section.
Figure 9:
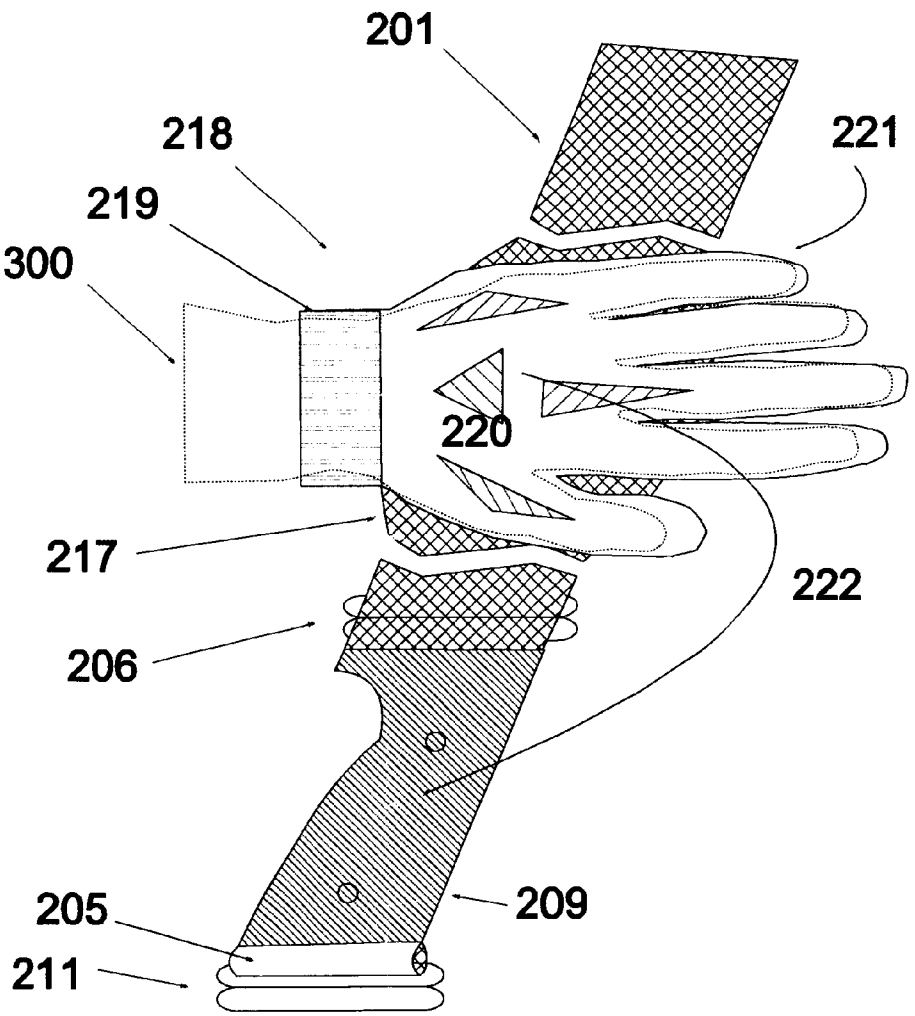
FIG. 9 is similar to the device of FIG. 8 except that the back of a right handed glove is secured to the inside surface of the hand covering portion of the double strap means.

It is another preferred embodiment that, as in FIGS. 8 and 9, the section 202 of FIGS. 5 and 7 are widened to form section 217. As appreciated from FIG. 9, section 217 provides a broader and more secure compression of portion 301 to the outside surface of piece 105. Such broader compression improves the weight transmission to the back of the hand / fingers portion 301 while preserving the ability of the user to flex their hand.

Figure 10:
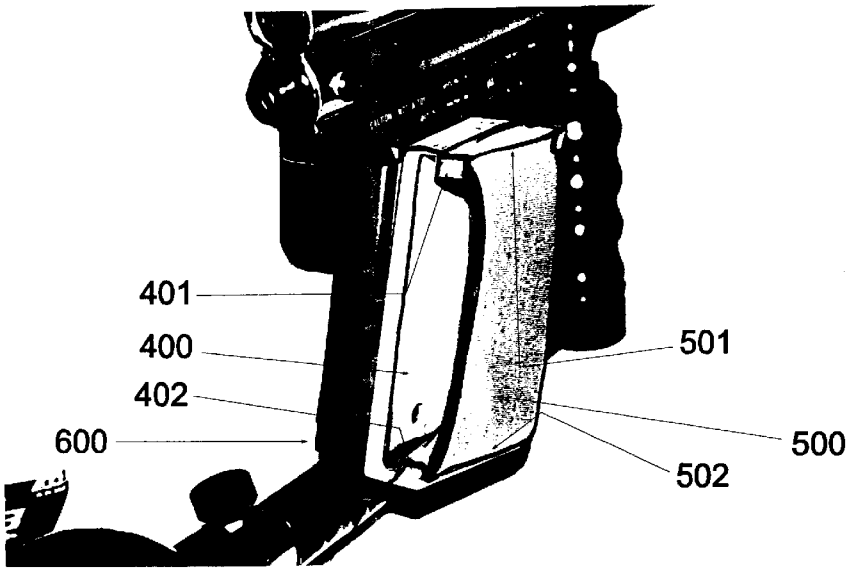
FIGS. 10 and 11 are perspective rearward and forward views of an alternate embodiment of the present invention.

It is another preferred embodiment of the present invention to provide a glove 218 having a wrist section 219, palm section 220 and tip section 221 within which hand 301 may be inserted as shown in FIG. 10. The backside of glove 218 in the area of section 220 is attached by stitching or adhesive to the inner surface of section 217, whereby such section was also shown in FIG. 8. The orientation of the glove 218 to section 217 is specific to that shown in FIG. 10, i.e., glove 218 is place such that when the user inserts their hand 300 into it, their glove covered palm will be open for receiving the outside surface piece 105 and the rest of pistol grip 104 when the user's arm rotates along path 222 to accomplish that reception. When section 201 is threaded as shown in FIG. 9 with the embodiment of FIG. 10, the user's hand is in glove 218 and most securely is connected with the double strap means of this embodiment and thereby to most securely support the weight of pistol 100 with the wrist instead of with palm and finger pressure.

It is an alternate embodiment to withdraw piece 209 to reduce cost of construction of the double strap means, although the elastic strap of the invention will tend to unfavorably shift and wear beneath the piece 105. It is also another embodiment of the present invention to provide a single strap and strap securement means by way of Velcro® closure between the opposing strap surfaces or other dual slot pieces. A single glove as in FIG. 10 may also be provided with palm attachment means, whereby a right hand grip piece may be adapted to have a mating palm attachment means, thus permitting securing engagement of the glove palm with the right grip piece.

Figure 11:
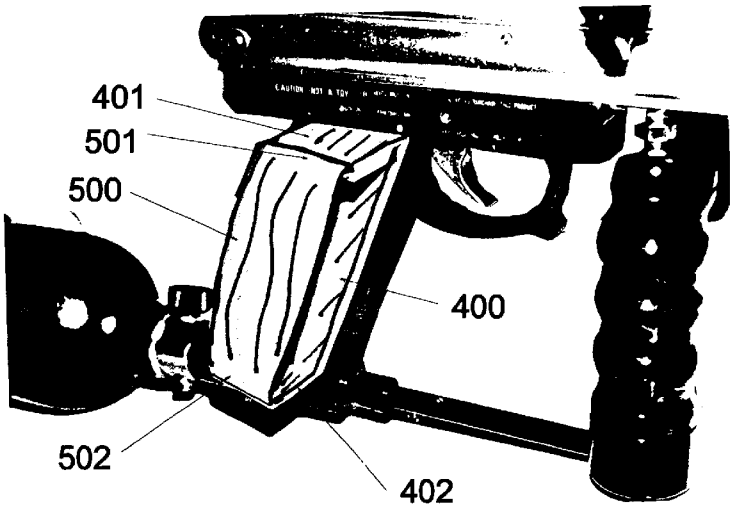

In FIGS. 11 and 12, an alternate embodiment of the present invention is shown. A paintball pistol frame handle 600 has attached to it a novel pistol grip piece 400 having a central rigid and flat section extending upward and downward in the position of a prior art pistol grip. At upper and lower distal ends of the pistol grip flat section, there extends from each distal end a supportive flange, i.e., an upper flange 401 and a lower flange 402. At the free end of each flange are attachment and/or adjustment means for flexible strap 500. Strap 500 is attached and/or adjustable in length at upper attachment end 501 to the free end of lower flange 501. Strap 500 is also attached and/or adjustable in length at lower attachment end 502 to the free end of lower flange 502. From the FIGS. 11 and 12 and this description it will be appreciated that the user's hand will be further supported primarily by the lower, inside surface of the upper flange 401 and thereafter held against the flat section of grip 400 by the stretched flexible strap 500. Lower flange 402 further secures the user's hand against the paintball pistol of FIGS. 11 and 12 by forcing a substantially parallel alignment of the user's palm to the longitudinal axis of the paintball pistol.

The above design disclosures present the skilled person with considerable and wide ranges from which to choose appropriate obvious modifications for the above examples. However, the objects of the present invention will still be obtained by the skilled person applying such design disclosures in an appropriate manner.

I claim:

1. A strap means for supporting a paintball pistol such that substantial weight is shifted from grasping pressure of the palm, thumb and fingers of a user of the pistol to the back of the hand of the user comprising:

(a) a first slot of a first dual slot means for engaging an elastic strap attached to a first end of a continuous elastic strap with a width greater than about 1.5 inches, the elastic strap extending to the a second, threading end;

(b) securely retaining between a pistol grip and a pistol grip frame section of the paintball pistol a first section of the elastic strap from the attachment to the dual slot means and effectively distal thereto, the remaining portion of the elastic strap comprising a second section adapted to press a user's hand to the pistol grip and a third section adapted to be threaded through a second slot of the first dual slot means;

(c) means for securing the third section such that securement is obtained after drawing the threading end on the third section distal to the first dual slot means to effectively compresses the hand of the user to the pistol grip; and (d) the first section additionally comprises a rigid piece about the same width and length as the elastic strap in the first section, the rigid piece adhesively applied to one side of the first section whereby the strap means are more effectively retained between the pistol grip and the pistol grip frame section.

2. The strap means of claim 1 wherein the first section comprises about the same planar outline as that of the pistol grip.

3. The strap means of claim 2 wherein the first section comprises about the same planar outline as that of the pistol grip.

4. A strap means for supporting a pistol such that substantial weight is shifted from grasping pressure of the palm, thumb and fingers of a user of the pistol to the back of the hand of the user comprising:

(a) a first slot of a first dual slot means for engaging an elastic strap attached to a first end of a continuous elastic strap with a width greater than about 1.5 inches, the elastic strap extending to the a second, threading end;

(b) adapting for securely retaining between a pistol grip and a pistol grip frame section of the pistol a first section of the elastic strap from the attachment to the dual slot means and effectively distal thereto, the remaining portion of the elastic strap comprising a second section adapted to press a user's hand to the pistol grip and a third section adapted to be threaded through a second slot of the first dual slot means:

(c) means for securing the third section such that securement is obtained after drawing the threading end on the third section distal to the first dual slot means to effectively compresses the hand of the user to the pistol grip; and (d) the first section additionally comprises a rigid piece about the same width and length as the elastic strap in the first section, the rigid piece adhesively applied to one side of the first section whereby the strap means are more effectively retained between the pistol grip and the pistol grip frame section.

5. The strap means of claim 4 wherein the rigid piece comprises about the same planar outline as that of the pistol grip.

6. The strap means of claim 5 wherein the first section comprises about the same planar outline as that of the pistol grip.

7. The strap means of claim 4 wherein a second dual slot means are threadingly engaged at a first slot and second slot with elastic strap at about the intersection of the first and second sections, whereby the threading engagement is adapted to permit secure threading of the threading end through the first and second slots of the second dual slot means whereby the hand of the user is compressed to the pistol grip with a dual thickness of the elastic strap, respectively, of the second and third sections.

* * * * *